US005191939A

United States Patent [19]

Stokley

[11] Patent Number: 5,191,939

[45] Date of Patent: Mar. 9, 1993

[54] CASING CIRCULATOR AND METHOD

[75] Inventor: Charles O. Stokley, Houston, Tex.

[73] Assignee: TAM International, Houston, Tex.

[21] Appl. No.: 663,322

[22] Filed: Mar. 1, 1991

[63] Related U.S. Application Data Continuation-in-part of Ser. No. 460,566 Jan. 3, 1990, Pat. No. 4,997,042.

[51] Int. Cl.[5] ..... E21B 33/04

[52] U.S. Cl. ..... 166/379; 166/85; 166/187; 166/387

[58] Field of Search ..... 166/379, 387, 77, 77.5, 166/85, 187, 380, 381, 90

[56] References Cited

U.S. PATENT DOCUMENTS

| | | | |
|---|---|---|---|
| 4,076,083 | 2/1978 | Sizer | 175/65 |
| 4,817,724 | 4/1989 | Funderburg, Jr. et al. | 166/337 |
| 4,913,231 | 4/1990 | Muller et al. | 166/250 |
| 4,997,042 | 3/1991 | Jordan et al. | 166/379 |

OTHER PUBLICATIONS

Halliburton Advertisement, Oil & Gas Journal, Apr. 17, 1989, "Halliburton can be on the casing and ready to cement this fast with its new Quick-Latch Coupler Head".

*Primary Examiner*—William P. Neuder

*Attorney, Agent, or Firm*—Browning, Bushman, Anderson & Brookhart

[57] ABSTRACT

Improved methods and apparatus are provided for inputting fluid into the uppermost end of a casing string gripped by an elevator supported from a traveling block by a pair of bails. The concepts of the present invention may be used to provide circulation from adjacent the lower end of the casing string and into a well bore to enable the casing string to be more easily lowered into the well bore, and may also be used to fill the casing string as it is lowered into the well bore. The casing circulator is provided for lowering into the uppermost end of the casing string above the rig floor, and for sealing with an interior surface of the uppermost end of the casing string. A support sub includes a hanger for suspending from the traveling block, and the casing circulator is supported from the support sub by a pup joint. The support sub is guided with respect to the bails by an adjustable alignment device, thereby ensuring that the circulator will be lowered into the casing string as the traveling blocks are lowered. Various techniques may be used to set the casing circulator, and an adjustment mechanism is provided to limit its upward travel when the casing string is pressurized.

19 Claims, 4 Drawing Sheets

CASING CIRCULATOR AND METHOD

This application is a continuation-in-part of application Ser. No. 460,566, filed Jan. 3, 1990, Pat. No. 4,997,042.

BACKGROUND OF THE INVENTION

1. Field of the Invention

The present invention relates to methods and apparatus for inputting fluid through the casing and into the well bore, and more particularly relates to simple and reliable techniques for sealing and circulating fluid through the casing utilizing equipment which may also be employed to fill the casing with fluid as it is being run into the well.

2. Description of the Background

In the oil recovery business, casing is commonly used as the outer conduit in a well bore, while tubing and drill pipe are generally positioned within the casing. When lowering casing into a well bore (also called running casing into a hole), it is not unusual to encounter difficulty in getting the casing to the desired depth in the hole, especially when the borehole is highly deviated. Typically, casing is "unstuck" in a hole by circulating fluid, such as drilling mud, down the casing to wash sand or other debris away from the vicinity of the lowermost end of the casing.

In most instances, this circulation requires the operator to "rig-up" on top of the uppermost end of the casing string, which typically is from 3 to 15 meters above the drilling rig floor. Since the position of the upper end of the casing string for this rig-up operation varies with the depth of the stuck casing in the well, the height at which rig-up occurs varies, and the uppermost end of the casing string is thus not readily accessible to the operator. Accordingly, an operator is frequently suspended in the air from a safety harness to perform "rig-up" on the uppermost threaded end of the casing string. Once rig-up has occurred, drilling fluid is typically circulated into the top of the casing string to achieve the washing operation, at which time the casing can be further lowered simultaneously or subsequently into the well bore.

In a conventional rig-up operation, a circulating sub is threaded onto the uppermost threads of the last joint of casing added to the string. Since this procedure commonly takes 30 minutes or more and, once the casing becomes stuck in the well bore, each successive joint of casing is likely to become restuck while the casing is run into the well, hours of valuable rig time and effort are required simply to attach and detach this circulating sub from the top of the casing string so that fluid can be circulated for the washing operation and the casing again lowered into the well.

Another common problem with lowering casing into a well bore is related to getting fluid into the casing as it is lowered into the well bore. While a check valve is typically provided at the lowermost end of the casing string to prevent well fluid from entering the interior of the casing as it is run into the well, fluid must be added to the lowered casing to prevent collapse of the casing during the run in operation. In most instances, a fill line from the existing mud pumps is manually placed into the exposed upper end of the casing string to fill the casing at desired intervals with fluid. This procedure typically takes several minutes per joint of casing, which amounts again to a considerable loss of rig time while running casing into a deep well.

The benefit of more quickly inputting a fluid into casing positioned in a borehole has long been recognized in the industry, and accordingly others have devised techniques for sealing the top of the casing string without threading a tool to the casing. Various types of quick couplers have been devised for positioning at the upper end of a casing string to circulate cementing fluid through the casing. These devices are not, however, generally suitable for circulating drilling or washing fluid into casing, since it still takes a considerable amount of time to properly install the coupler on the uppermost end of the casing string. Moreover, these devices do not overcome the previously mentioned problems concerned with the safety risks and an expense associated with circulating fluid into a casing by positioning an operator at varying heights far above the rig floor. Finally, these quick couplers do not solve the problems associated with easily filling the casing with drilling mud as a casing is run into the well.

The disadvantages of the prior art are overcome by the present invention, and improved methods and apparatus are hereinafter disclosed for easily and reliably circulating fluid through casing and into a well bore and/or filling casing with fluid as it is lowered into the well bore.

SUMMARY OF THE INVENTION

The techniques of the present invention are applicable for easily and inexpensively inputting drilling mud into a casing positioned within a well bore. The fluid may be used for conventional washing operation to enable the casing to be more easily lowered into the well bore, and may also be used for filling the casing with mud during the casing run-in operation to prevent collapse of the casing due to pressure differential across the casing wall.

The casing circulator and techniques for inputting fluids to a casing string as discussed herein are applied to a conventional rig, wherein the rotary table is provided at the rig floor. A conventional elevator is used to grip the uppermost end of the casing string, and is suspended from a traveling block by a pair of bails. A circulator support sub is suspended from the traveling block, and a casing circulator is connected to the circulator sub via a pup joint. A gooseneck is provided on the support sub for the kelly hose, and a rotatable seal mechanism within the circulator sub allows the gooseneck to rotate with respect to the support sub body and thus the casing circulator. The circulator is centralized with respect to the casing by a pair of guides fixed to the sub and for guided engagement with the bails. An adjustable stop mechanism is provided for limiting upward movement of the set casing circulator as pressure within the casing is increased.

The casing circulator comprises a packer tube having a central flow path for transmitting fluid through the circulator. A top sub may be connected to the upper end of the packer tube, and includes internal threads for connecting an upper drill pipe pup joint thereto. A sleeve-shaped inflation element is positioned exterior of the packer tube, is sealed on the packer tube at both ends to form an inflatable chamber between the inflation element and the tube, and may either be axially moveable or fixed with respect to the tube. A lower guide member is secured to the lowermost end of the packer tube to assist in guiding the tool into the interior of the casing string.

The inflation element is selectively actuatable for providing sealing engagement between the interior surface of the casing and the packer tube. Although a fluid-actuatable sealing element is preferred, other types of sealing means can be used in accordance with the present invention. A plurality of slots may be provided in the packer tube to allow fluid to enter and inflate the sealing element, and in one embodiment the sealing element is axially moved so that pressure is sealed (packer set) while the slots provide communication between the interior of the packer tube and the interior of the casing below the sealing element.

According to the method of the present invention, the casing circulator may be positioned within the upper end of the casing string, and is supported from a pup joint between the circulator and the support sub, which in turn is suspended from the traveling block of the rig. During normal operations, the inflation element is in its unset position, and the slots in the packer tube are positioned below the inflation element so that the interior of the casing is open to the interior of the pup joint. Accordingly, the casing may be easily filled as the casing is run into the bore hole.

In the event the casing becomes stuck in the well bore, the inflation element may be set by releasing the elevator and actuating the drawworks to lift the traveling block upward. The packer tube moves up with the traveling blocks, and thus moves up with respect to the inflation element, causing the slot to rise above the seals in the lower packer sub and fill the inflation element. The subsequent lowering of the packer tube seals the inflation element in its set position, and again opens the slots to the interior of the casing so that mud may be pumped through the casing circulator and into the casing for performing the washing out operation. Alternatively, the packer may be set by fluid pressure from another line, and mud pumped through the set packer. Once washout is complete, the mud pump may be shut off and the packer deflated. The process may be easily repeated each time the casing becomes stuck in the bore hole.

It is an object of the present invention to provide improved techniques for easily and quickly performing a washing operation to assist in lowering casing into a well.

It is another object to provide a readily actuatable casing circulator within the upper end of a casing string, so that the casing circulator may be actuated to seal with the casing interior walls while enabling fluid to be pumped through the casing circulator and into the casing.

It is a feature of the present invention that rig operator safety is enhanced since an operator need not be suspended adjacent the upper end of the casing string to rig up the casing for a washing operation.

It is another feature of the invention that the casing circulator be used for performing a casing washing operation, and the same casing circulator may also be used for easily filling the casing as the casing is run into the well.

It is yet another feature of the invention that the casing circulator is supported from a support sub, which in turn is supported from a traveling block, and that the alignment of the casing circulator with respect to the casing is assisted by guides for engagement with the bails extending from the traveling block.

A further feature of the invention is that an adjustable stop mechanism is provided for limiting upward movement of the set casing circulator in response to increased pressure in the casing.

It is an advantage of the present invention that the casing circulator employs a sealing mechanism for preventing drilling mud within the interior of the casing circulator from inadvertently spilling onto the rig floor.

It is still a further advantage of the present invention that the techniques described herein may be used with a conventional drive rig having a rotary table at the rig floor.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
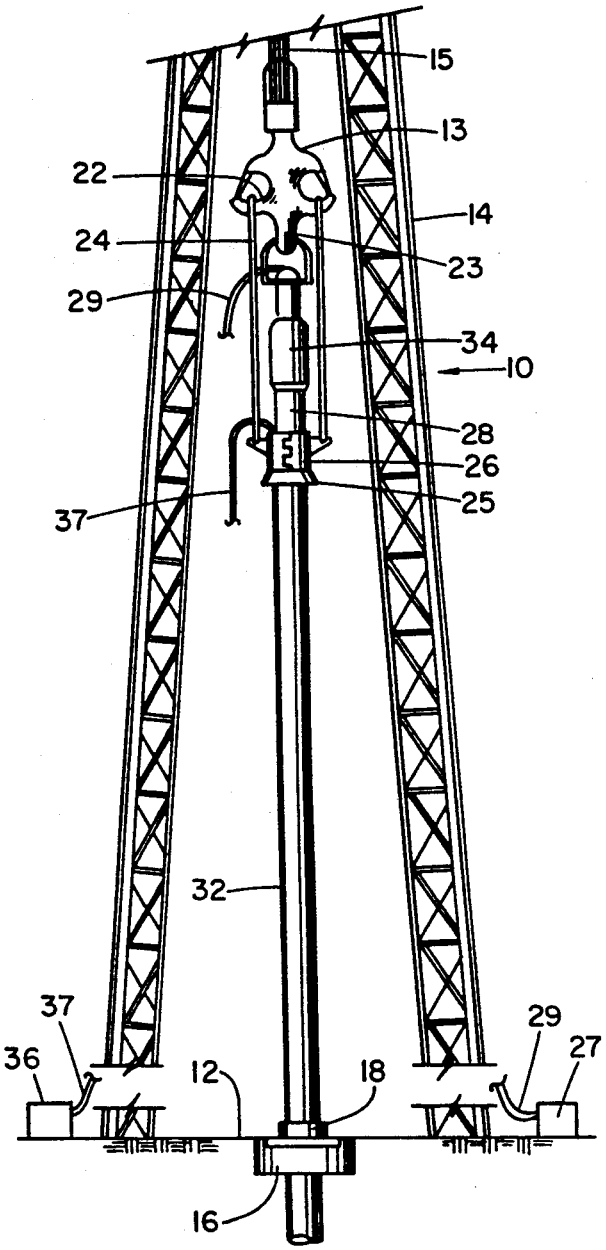
FIG. 1 is a simplified side view of a conventional rig with a rotary table at the rig floor which may be used in accordance with the present invention.

FIG. 1 depicts a portion of a conventional drilling rig 10 which is well suited to achieve the benefits of the present invention. The rig 10 as shown in FIG. 1 may thus consist of a conventional rig floor 12 and a suitable structure or masts 14 extending above the rig floor for supporting a stationary crown block (not shown). A rotary table 16 is provided just below the rig floor, and a conventional spider 18 is provided for gripping the casing string 32. Wire cables 15 conventionally extend from drawworks adjacent the rig floor to the crown blocks and then to the traveling blocks 13 so that traveling blocks 13 can be easily moved up or down relative to the rig floor by actuation of the drawworks.

The rig 10 as shown in FIG. 1 may include a pair of bails or links 24, each suspended from side ears 22 of traveling blocks 13, and a casing elevator 26 suspended at the lower end of the bails. The traveling block 13 also includes a hook 23 at its lower end, which is discussed subsequently. This apparatus is conventional and well known to those skilled in the art, and accordingly will not be discussed in detail herein. It should be understood that the uppermost portion of the casing string 32 may be gripped by the elevator 26, so that the actuation of the drawworks can be used to lower the casing elevator 26 and thus the casing into the hole with the rotary table slips 18 disengaged. FIG. 1 thus depicts the casing string 32 suspended from the elevator 26, and the casing will continually be gripped and supported from slips in either the elevator 26 and/or the rotary table. It should be understood that the term casing, as used herein, refers to any tubular oilfield product which may become struck in a well and/or needs to be filled with fluid as it is lowered into the well.

Figure 2:
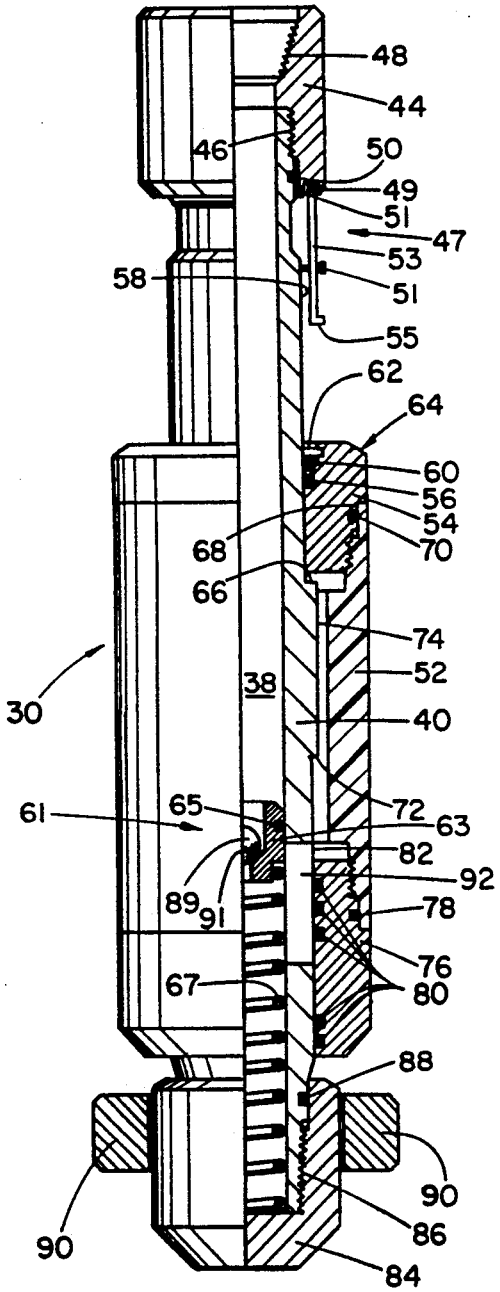
FIG. 2 is a detailed half-sectional view of a casing circulator according to the present invention.

A casing circulator support sub 34 and a casing circulator 30 (not shown in FIG. 1), are provided according to the present invention. The support sub 34 is suspended from the hook 23 of the traveling block 13. A short pup joint 28 shown in FIG. 1 is threadably connected to sub 34, and the casing circulator 30 discussed subsequently may be supported within the uppermost end of the casing string 32 from the end of the pup joint 28. Fluid from the mud pumps 27 adjacent to rig floor may be passed to the support sub 34 by a flexible line 29, then passed through the pup joint 28 to the interior of the packer tube 40 as shown in FIG. 2. As explained subsequently, a separate flow line 37 could also be used to pass pressurized fluid from hydraulic pump 36 at the rig floor directly to the casing circulator 30, which enables the techniques of the present invention to be used to set the casing circulator with fluid other than the drilling fluid which fills the casing 32.

Details with respect to one embodiment of the casing circulator 30 are shown in FIG. 2. The casing circulator consists of a packer tube 40 having a central flow path 38 for passing fluid through the casing circulator, as explained subsequently. A top sub 44 is connected to the upper end of the packer tube 40 by threads 46, and a fluid tight connection between the top sub and the packer tube is achieved by annular seal 50. The top sub 44 includes conventional internal tapered threads 48 for forming a fluid tight connection with the threaded end of the drill pipe pup joint 28 shown in FIG. 1.

An upper external cylindrical-shaped surface 58 of the packer tube 40 forms a seal with the upper packer sub 54 by plurality of annular seals 56. The packer sub 54 includes a snap ring 60, and an annular locking slot 62. Accordingly, the upper packer sub 54 may move axially upward toward the top sub 44 along the cylindrical exterior surface 58, as explained subsequently, while maintaining sealed engagement between the upper packer sub 54 and the packer tube 40. Downward movement of the packer sub 54 with respect to the packer tube is limited by stop surface 66 formed on the packer tube.

The inflation element 52 is secured at its upper end to the packer sub 54 in a manner conventional to inflatable packers, and a fluid-tight connection between these components may be provided by annular seal 70. Even when the inflation element is in its deflated condition, as shown in FIG. 2, a thin annular gap 74 may thus exist between the exterior surface of the packer tube and the interior of the inflation element, and this gap 74 may subsequently be filled with pressurized fluid to expand the inflation element 52 outward into sealed engagement with the casing string.

A lower packer sub 76 is secured to the lower end of the inflation element 52, and a plurality of seals 80 carried by the lower sub provide sealing engagement between the exterior cylindrical-shaped surface 82 of the packer tube 40 and the lower sub 76. Accordingly, those skilled in the art appreciate that as the packer is inflated, the lower sub 76 moves axially closer to the upper packer sub 54 to accommodate radially outward expansion of the inflation element 52. Upward movement of the lower sub 76 with respect to the packer tube 40 is limited by stop surface 72. Again, a fluid tight connection between the inflation element and the lower sub may be provided by seal 78.

Guide member 84 is connected to the lower end of packer tube 40 by threads 86. A variety of different types of guide projections 90 may extend outwardly from 84, and assist in guiding the assembly 30 into the upper end of the casing string, as explained subsequently. FIG. 2 depicts one of a plurality of slots 92 which extend through the sidewalls of the packer tube 40. A latch mechanism 47 is connected to top sub 44 for retaining the inflation element 52 in its upper position with respect to the packer tube 40, so that the circulator 30 may be used for filling the casing string without inflating the packer, as explained subsequently. Latch mechanism 47 is pivotably connected at 49 to sub 44, and a set and release bolt 51 may be provided in the downwardly projecting arm 53, which has an outwardly projecting finger 55 for fitting within the annular slot 62 in the top sub 54.

To prevent the drilling fluid within the casing circulator 30, the pup joint 28, and the support sub 34 from inadvertently falling to the rig floor, a seal mechanism 61 is provided within the central flow path 38 of the packer tube 40. A piston 63 includes seal 65 for sealing engagement with the interior wall of the packer tube, and spring 67 biases the piston to a position such that the seal 65 is above the slots 92 when no downward fluid pressure is applied to the piston. The ball 89 may be provided for sealing engagement with seat 91 on a piston and prevents fluid pressure in the casing string 32 from becoming greater than fluid pressure above the piston.

The casing circulator 30 may be used to fill the casing string 32 with the latch 47 retained in engagement by bolt 51 holding the finger 55 in the slot 62, thereby maintaining the slots 92 exposed and below the seals 80. With each new casing joint added to the string, the casing circulator will automatically enter the interior of the casing string as the elevator 26 is lowered to grasp the casing string. If the casing string becomes stuck in the well, an operator may be raised with a harness to unthread bolt 51, thereby allowing the packer element 52 to drop to the position as shown in FIG. 2. With the ball 91 in place, the application of mud pressure in line 29 will drive the piston downward, compressing the spring 67 and providing fluid communication between the slots 92 and gap 74 to inflate the sealing element 52. As explained subsequently, the casing circulator as shown in FIG. 2 thus has the advantage of using drilling fluid to both set the casing circulator and wash fluid to the lowermost end of the casing string for unsticking the casing string.

Figure 7:
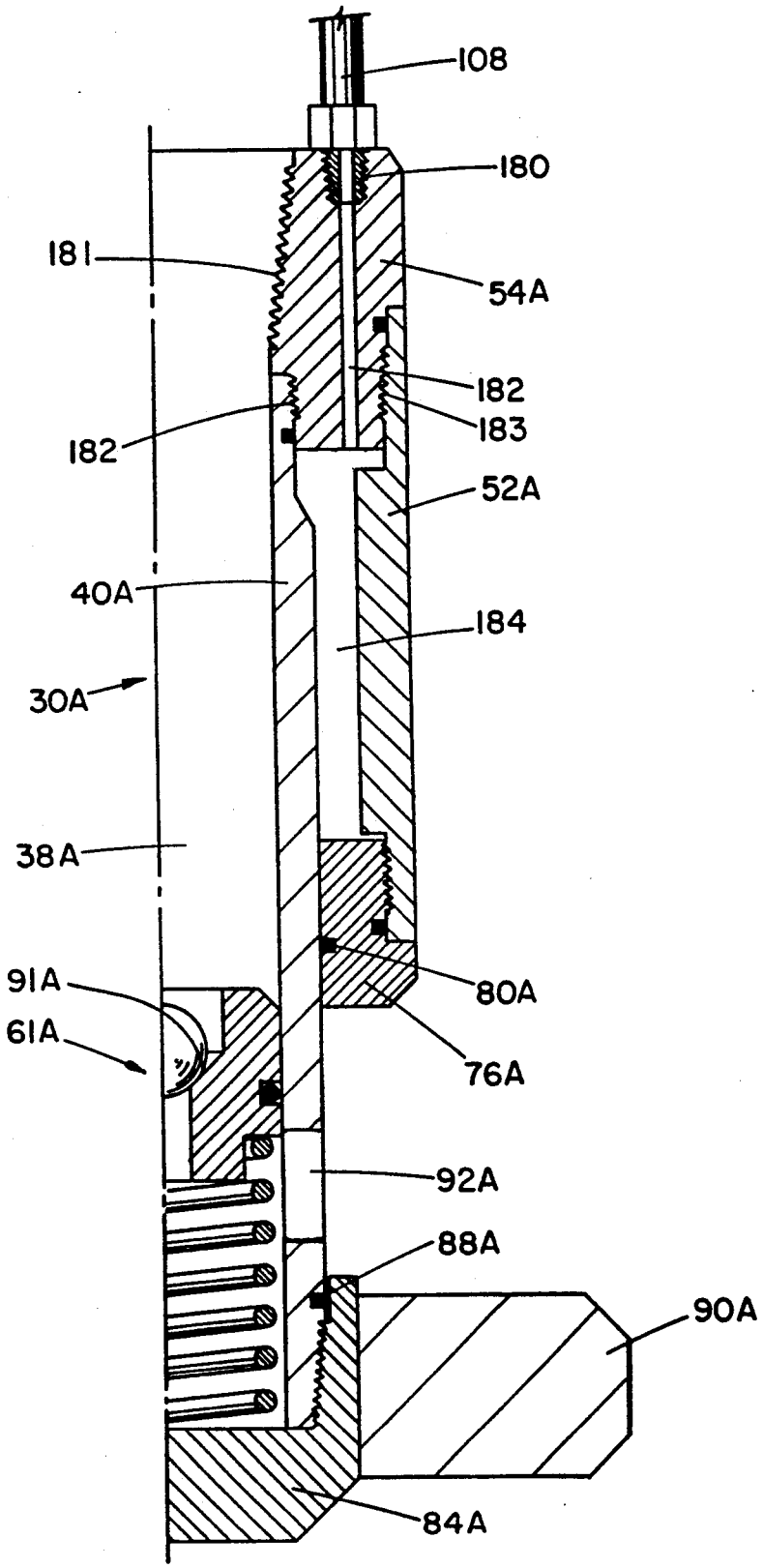
FIG. 7 is a half-sectional view of an alternate embodiment of the casing circulator shown in FIG. 2.

A simpler embodiment of a casing circulator 30A as shown in FIG. 7, with the A designation being used for components similar or identical to those discussed with respect to FIG. 2. The casing circulator 30A is relatively simply in construction and operation, since the sleeve 40A is fixed to the top sub 54A at threads 182. Threads 181 in top sub 54A may be connected directly to the pup joint 28, and a separate flow line is used to inflate the casing circulator. External tubing line 108 is in fluid communication with fluid line 37 shown in FIG. 1, and is in sealing engagement with flow path 182 with sub 54A via fitting 180. Hydraulic fluid from pump 36 may be transmitted through line 37, line 108, passageway 182, and to chamber 184 to inflate the sealing element 52A. Threads 183 interconnect the sealing element 52A to both the top sub 54A and the bottom sub 76A, and the lower sub 76A is axially movable with respect to the top sub and is maintained in sealed engagement with the external surface of tube 40A by seal 80A. Guide member 84A and guide projection 90A may be similar to the components previously discussed. Slots 92A are always exposed to the interior of the casing string when the circulator 30A is within the casing string.

To fill the casing string using the casing circulator shown in FIG. 7, fluid pressure in line 27 is increased to drive the mechanism 61A downward to open the slots 92A. The release of fluid pressure in line 37 will allow the sealing mechanism 61A to return to the position as shown in FIG. 7, so that fluid within the casing circulator, the sub 28, and the casing support 34 will not thereafter leak past the sealing mechanism. If the casing becomes stuck in the well, fluid pressure is applied by pump 36 to line 37, and the sealing element, 52A inflated into sealed engagement with the casing. With the casing circulator 30A set, the subsequent pumping of fluid through line 29 will drive the sealing mechanism 61A downward and wash the lowermost end of the casing string.

Figure 8:
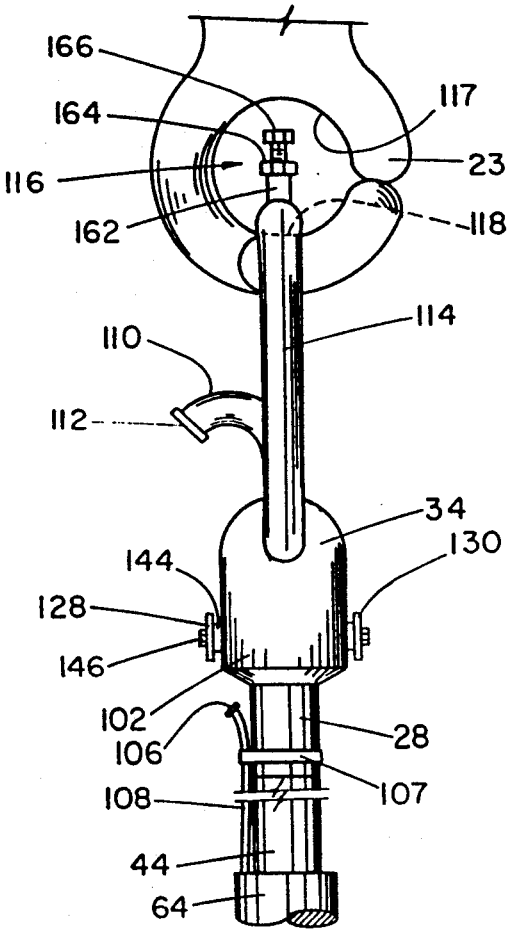
FIG. 8 is a simplified side view of the upper hook portion of a traveling block, a circulator support sub suspended from the traveling block, a pup joint, and an upper portion of the casing circulator.

FIG. 8 more clearly depicts the suspension of the casing circulator support sub 34, the pup joint 28, and the casing circulator 30 from the hook 23 of the traveling block 13. The support sub 30 includes a housing 102 having a flow path 104 (see FIG. 9) therethrough. A pair of guide rails 128 and 130 discussed subsequently are mounted to the housing 102. A curved tubular member or gooseneck 110 is rotatably mounted to the upper end of the housing 102, and has a quick disconnect flange 112 at the end thereof. The lower end of housing 102 is threaded at 126 for engagement with the pup joint 28, and the casing circulator 30 is threadably connected to the lower end of the pup joint. Hose 29 as shown in FIG. 1 may thus be quickly connected and disconnected from the gooseneck 112, and fluid pumped through the flow path in 110, through the flow path 104 in housing 102, through the pup joint and to the casing circulator to (a) set the casing circulator as explained below and pump fluid under pressure down the casing 32, or (b) pump fluid through and out the casing circulator to fill the casing. For the alternate embodiment as shown in FIG. 7, a quick disconnect end 106 may be provided exterior of the pup joint 28 for connecting with hydraulic hose 37 shown in FIG. 1, and a flexible flow line 108 connected between end 106 and the chamber within the casing circulator for setting the circulator. Any connection mechanism, such as a simple strap 107, may be used to secure the tubing 108 in place to the exterior of pup joint 26. In this case, the flow line 29 may be used to pump pressurized mud down the casing string and to fill the casing string, but the casing circulator is set and unset by applying and releasing fluid pressure to the inflatable element through line 37 and flexible hose 108. As still a further embodiment, hydraulic line 37 could be eliminated and the casing circulator mechanically set and unset, although this arrangement is not preferred for most situations since a mechanism separate from the traveling block would be required to mechanically set and unset the casing circulator.

FIG. 8 also depicts an adjustable stop mechanism 116 mounted on top of the hanger 114 of the support sub 30. The details of the stop mechanism 116 are discussed below, although it should be understood that mechanism 116 limits upward travel of the hanger 114 and thus the entire support sub 34, the joint 28 and the casing circulator 30 with respect to the traveling block hook 23. When casing circulator 30 is deflated, the hanger 114 merely rests on the lower surface 118 of the hook 23 to support the weight of the support sub 34, the pup joint 28, and the casing circulator 30 (typically less than about 1,000 pounds). When the casing circulator 30 is set and fluid pressure is applied to the casing string through line 29, substantial upward force is exerted on the casing circulator which may tend to lift the casing circulator upward out of the casing string 32 and thereby break the seal. To limit this upward movement, adjustment mechanism 116 is provided so that upward movement of the hanger with respect to the hook 23 is limited. Mechanism 116 is adjustable and may be easily and quickly altered to a desired height at the rig site, depending upon the size of the hook 23 and thus the distance between the top of hanger 114 and the upper surface 117 of the hook 23.

Figure 9:
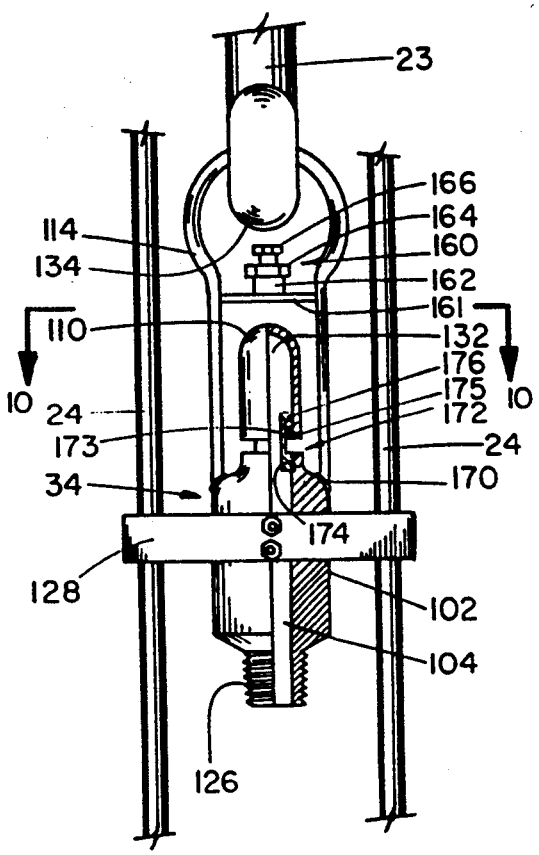
FIG. 9 is a more detailed front view, partially in cross-section, of an alternate embodiment of a circulator support sub according to the present invention, including an adjustable stop mechanism for engagement with the lowermost portion of a traveling block hook.

FIG. 9 depicts more clearly the general configuration of the hanger 114, which may be originally secured to body 102 of the sub 34 by mounting plates 170. In FIG. 9, the gooseneck end 112 is not visible, the casing circulator 30 has been removed, and the position of guide plate 128 with respect to bails 24 is illustrated. Upward movement of the casing circulator with respect to the traveling block 13 may be limited by controlling upward movement of hanger 114 with respect to block 23 using adjustable stop mechanism 116 as shown in FIG. 8, or may be limited by a similar adjustable stop mechanism 160 as shown in FIG. 9 which engages lower surface 134 of hook 23. Adjustment stop mechanism 160 may be fixed to the hanger 114 by support plate 161, or may be fixed directly to the body 102 of support sub 34. Each adjustable mechanism 116 and 160 may include a tubular member 162 having a nut 164 fixed on top, and a bolt 166 for threaded engagement with the nut 164. By selectively rotating the bolt 166, the spacing between the head of the bolt and the surface 117 or 134 may be adjusted, thereby limited upward movement of the casing circulator 30 with respect to the traveling block and thus with respect to the casing 32. Also, a conventional lock mechanism may be provided for fixing the position of the bolt 166, e.g., using a locknut (not shown) for torqued engagement with the fixed nut 164, so that the selected position of the bolt head does not change due to vibration during use of the equipment.

It is a feature of the present invention that the rotatable position of support sub body 102 be fixed (or very limited) with respect to the bails 24, and that the gooseneck 110 which interconnects the line 29 and body 102 rotate with respect to the body so that the hose 29 does not impart a significant torque on the support sub during operation of the equipment. Accordingly, a rotational seal unit 172 is provided between the gooseneck 110 and body 102 of the support sub to maintain fluid tight communication between the flow channels while allowing the gooseneck to rotate approximately 135° between the arms of the hanger 114. Unit 172 includes a neck 173 threadably connected at 174 to body 102, with the upper end of neck 173 including a seal 176 for maintaining fluid-tight engagement with the inner cylindrical surface of the gooseneck 110. A stop ring 175 is threadably connected to the lower end of the gooseneck 110, and provides a stop for limiting upward movement of the gooseneck with respect to body 102. Accordingly, the rotational seal unit 172 allows the gooseneck 110 to freely rotate with respect to the body 102 while maintaining sealed engagement therewith, and also allows axial movement of the gooseneck with respect to the body.

Figure 10:
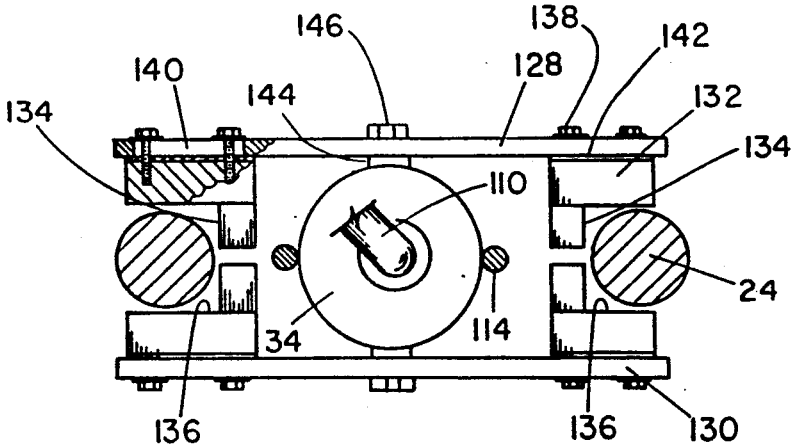
FIG. 10 is a detailed top view of casing circulator support sub according to the present invention, illustrating the adjustable guide mechanisms to align the sub and the casing circulator with the casing utilizing the bails.

FIG. 10 illustrates a top view of the support sub 34 with respect to the bails 24 and also shows the adjustment components which allows the casing circulator to be used with various sizes of bails and traveling blocks. Those skilled in the art recognize that the spacing between the bails 24 is a function of the specific traveling blocks and elevators used, and that the size and thus the cross-sectional area of the bails vary slightly with different drilling operations. According to the present invention, the position of support sub 34 is guided so that the casing circulator 30 secured thereto will automatically slide within the casing string 32 when the elevator 26 is positioned about the casing string.

Referring to FIGS. 1 and 9, adjustment of the support sub 34 and thus the casing circulator 30 with respect to the casing string 32 is controlled by guide members 132 positioned at the ends of both of the guide plates 128 and 130. Outward surfaces 134 of members 132 are positioned for engagement with the bails 24 to control the lateral position of the casing circulator, i.e., its proper position in a direction extending between the central axes of the bails. Surfaces 136 of the members 132 similarly control transverse position of the casing circulator, i.e., in a direction perpendicular to the line extending between the central axes of the bails. Each of the members 132 may be laterally adjustable by sliding bolts 138 to a desired position along a slot 140 at both ends of 128 and 130, then tightening the bolts 138 to lock the members 132 in place with the surfaces 134 at their desired lateral position with respect to the bails. Transverse adjustment may be achieved, if necessary, by utilizing selected thickness pads 142 between the guide plates 128, 130 and the members 132, thereby positioning the surfaces 136 at a selected transverse position with respect to the bails. Traverse adjustment of the plates 128 and 130 normally is required, although if the casing circulator and support sub were used with a rig having unusually large bails, pads 144 may be used between the casing circulator and the support sub 34.

Prior to hanging the support sub, the members 132 may be adjusted so that limited lateral and transverse "play" of the sub 34 and thus the casing circulator 30 with respect to the bails 24 is possible, thereby ensuring that the casing circulator will subsequently be automatically stabbed into the casing string. Also, the mechanism 116 or 160 may be adjusted so that limited upward movement of the casing circulator is possible once the circulator is set and the casing string pressurized. These adjustments typically may be made at the rig floor since the relevant dimensions of the bails 24 and the hook 23 will be generally known, although precise adjustment may be made, if desired, once the equipment is initially hung from the traveling block. The drilling crew may thus hang the support sub 34 from the 23 of the traveling block so that the gooseneck 110 is generally directed toward the pumps which will supply drilling mud to the casing circulator. The length of the pup joint 28 will depend upon the particulars of the drilling operation so that the casing circulator will be situated within the casing string 32 a desired depth when the top of the casing string is latched by the elevator.

A suitable technique for circulating drilling mud through the casing string from the lowermost end thereof into the well bore will now be discussed. FIGS. 3–6 depict a casing circulator 30 according to the embodiment as shown in FIG. 2 adjacent the uppermost end of a casing string 32. The bails 24 and elevator 26 as shown in FIG. 1 are even more simplified than as depicted in FIGS. 3–6 since the primary emphasis of this discussion is based upon use of the casing circulator and its axial relationship with respect to the casing string 32 and elevator 26.

The pup joint 28 may be threaded to the support sub 34 so that the casing circulator 30 threaded to the lower end of the pup joint will be substantially axially aligned by the guide plates 128 and 130 and the adjustment members 132 with respect to the casing string as the traveling block 13 is lowered, so that elevator 26 may grip the uppermost end of the casing string 32. The elevator 26 may include a lower guide skirt 25 to assist in enabling the elevator to become aligned with and be lowered over the casing string. When the casing string 32 is aligned with the elevator, the casing circulator will be lowered into the flow path of the casing string as the elevator is lowered about the casing. The casing circulator will thus be suspended from the sub 34 and the traveling block 13 before the casing becomes stuck in the well bore, and may be maintained in its deflated position. As each joint of casing is added to the drill string, the casing circulator 30 is "stabbed" into the top of the newly added casing without additional operator action, and the elevator 26 latched in a conventional manner.

In the event the casing string 32 becomes stuck in the well bore, the operator may secure the casing to the slips at the rig floor 12, since the casing once unstuck will not be supported by the elevator. If the casing circulator is latched in its up position, bolt 51 may be unthreaded to release the top sub 44 from the top packer sub 54. The mud pumps may be activated to lower the piston 63 and compress the spring 67 to pass drilling mud through the interior of the packer tube 40 and into the annulus 74 to inflate the sealing element to its inflated position. Once the desired inflation pressure is obtained, e.g., 1000 PSI, bails 24, elevator 26, and packer tube 40 may together be further lowered (slack off operation) so that the slots 92 drop below the seals 80. At this stage, the interior 38 of the casing circulator 30 is in fluid communication with the interior of the casing string, yet the casing circulator is maintained in its inflated position. Accordingly, the operator may then again activate the mud pump to pass fluid through the casing circulator to wash debris and lubricate the lowermost end of the casing string to enable further lowering of the casing string into the well bore. The elevator 26 may be reactivated during this washing operation to grip the uppermost end of the casing string, and the casing string released at the rig floor, so that the casing circulator can be simulataneously lowered into the well bore by lowering the elevator 26 while the washing operation is occurring.

Figure 6:
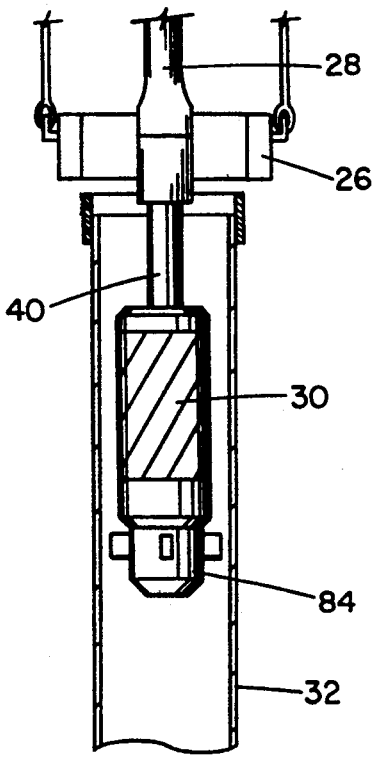
FIG. 6 is a simplified side view of a casing circulator in its unset condition with no fluid communication between the interior of the casing circulator and the interior of the casing.

At the end of the washing operation, the mud pumps may be deactivated and the pressure bled off the casing string. Release of pressure in line 27 automatically releases pressure in the casing string due to the check ball 89. With the elevator 26 again detached from the casing string and the casing secured at the rig floor, the drawworks may be activated to "pick-up" on the casing circulator to cause the slots 92 to rise above the seals 80. This action causes the annulus 74 to be in fluid communication with the interior 38 of the packer tube 40 and thus the interior of the casing string to deflate the casing circulator to the position as shown in FIG. 6. The process may be easily repeated, and latch mechanism 47, once deactivated, may remain deactivated. When a new joint of casing is added to the casing string, drilling fluid is prevented from leaking out the rig floor by the piston 63.

Figure 3:
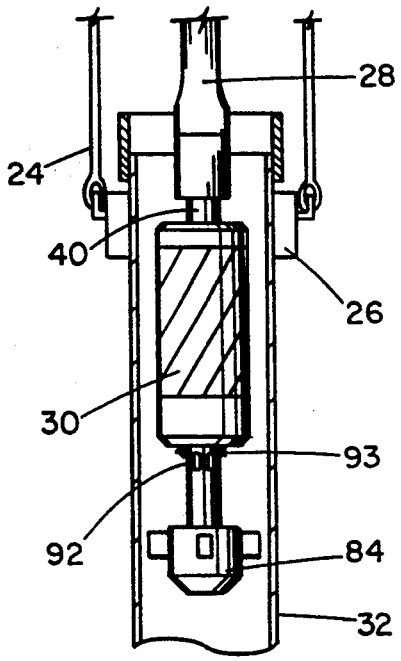
FIG. 3 is a simplified side view of a casing circulator in its unset position and opened for communicating fluid through the casing circulator and into the interior of the casing.
Figure 4:
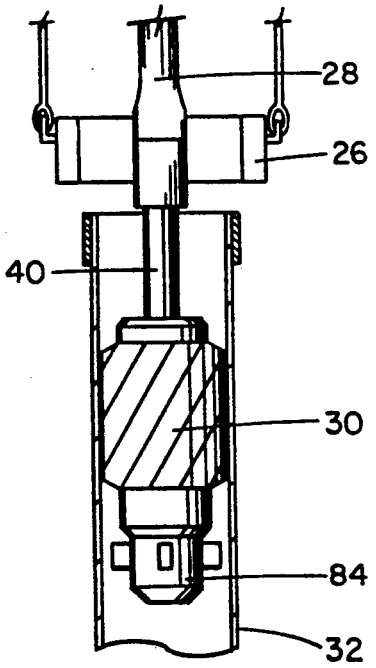
FIG. 4 is a simplified side view of a casing circulator in its set position with no fluid communication between the interior of the casing string and the interior of the casing circulator.
Figure 5:
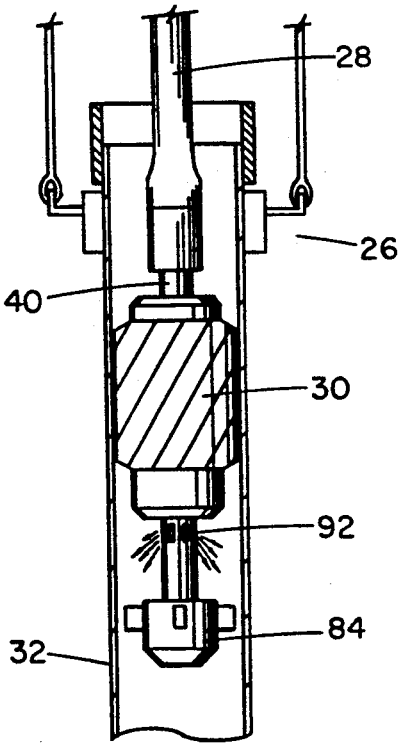
FIG. 5 is a simplified side view of the casing circulator in its set position, but with fluid communication permitted between the interior of the casing circulator and the interior of the casing.

Referring again to FIG. 3, it should also be understood that the casing circulator of the present invention may also be used to easily fill the casing string with drilling mud as it is lowered into the well bore, thereby saving valuable rig time. Those skilled in the art appreciate that a significant downhole differential in pressure must be avoided, and accordingly it is customary to intermittently fill the casing with a flexible hose to increase the hydrostatic head with the casing when its uppermost end is generally adjacent the rig floor. To accomplish this filling function according to the present invention, the casing circulator 30 may be stabbed into the top of a newly added casing, as shown in FIG. 3, with the elevator 26 deactivated and the casing secured at the rig floor. The elevator 26 may then be activated to grip to the uppermost end of the casing string 32, and the casing released at the rig floor. As the drawworks are activated and the casing string is lowered into the well bore, the mud pumps may be briefly activated to simultaneously fill the casing string, thereby minimizing the likelihood of collapse of the casing string. Although this objective customarily is accomplished in the prior art by manually placing the end of a flexible hose within the uppermost end of the casing string, the techniques for the present invention result in little or no additional time required to properly fill the casing string with drilling mud. Once the casing is properly filled, the mud pumps may be shut off, the elevator 26 unlocked, and the process repeated with the next joint of casing. Piston 63 continues to prevent drilling fluid within the casing circulator, pup joint or support sub from leaking onto the rig floor.

The casing circulator 30 may thus be used to easily fill the casing string as it is lowered in the bore hole, utilizing a process which maintains the desired hydrostatic head within the casing string yet requires no additional operator (or rig) time. Fluid is simply pumped through the casing circulator 30, preferably as the casing string is lowered into the well, so that time is saved by not having to have an operator intermittently fill the casing string with fluid. Also, the apparatus of the present invention can be easily used to pressure test casing, since the casing circulator discussed herein is able to reliably seal the top of the casing string and thereby establish the necessary sealed cavity within the casing string to conduct the pressure test.

Rather than utilize drilling mud to both set the casing circulator and circulate fluid through the casing string, the casing circulator as shown in FIG. 7 may be set and unset by supplying one fluid to the inflatable element, and then pumping drilling mud through the casing circulator to free the stuck casing. In this case, the external flow line 29 as shown in FIG. 1 may extend to the connection 106 on the pup joint 28 shown in FIG. 8, and then through flexible line 108 to the casing circulator. Flexible line 29 could thus be connected to a single relatively small hydraulic pump to set the casing circulator. Generally, it is anticipated that between 250 and 1500 PSI and preferably about 300 to 1,000 PSI is used to inflate the casing circulator according to the present invention. The casing circulator as shown in FIG. 7 may be used to either fill the casing string with drilling fluid, or may be used for a washing operation by setting the circulator prior to activating the mud pumps 27. In either case, the slots 92A remain exposed to input fluid to the casing string once pressure is sufficient to drive the mechanism 61A down to expose the slots in the packer tube. Also, it should be understood that the casing circulator need not be limited to one that utilizes an inflatable sealing element, and a mechanically activated sealing element for the casing circulator could be used. This later embodiment is not preferred, however, since components other than the traveling block 13 would be desirable for mechanically setting and unsetting the casing circulator.

Various techniques may be employed to facilitate the release of the connection between the inflation element and the packer tube to place the casing circulator into service for the sliding packer tube embodiment as shown in FIG. 2, and the mechanism 47 is exemplary. Various types of alignment members may be used to properly position the circulator sub and thus the casing circulator with respect to the bails, and the mechanism as shown in FIG. 10 represents one of several types of such alignment devices which will now be apparent to those skilled in the art. Thus various techniques are contemplated and are within the scope of this invention for releasably connecting the packer tube and sealing element, for allowing the fluid pressure to set the sealing element, for thereafter allowing fluid flow through the set or unset casing circulator and into the casing, for guiding the position of the circulator so that it will automatically stab into the top of the casing string when the traveling block is lowered, and for limiting upward movement of the set circulator within the casing string. Accordingly, the invention is limited not by the specific structures and embodiments described herein, but by the scope of the claims below.

What is claimed is:

1. An improved method of circulating fluid through a casing string and from a lowermost end of a casing string into a well bore for facilitating lowering of the casing string into a well bore, an uppermost end of the casing string extending above the rig floor to a position adjacent an elevator for grasping the uppermost end of the casing string and moving the casing string axially with respect to the rig floor, the elevator being supported from bails extending from a traveling block of the rig, the method comprising:

providing a casing circulator having an exterior sealing member and an interior packer tube defining a flow path therein;

providing a casing circulator guide for engagement with the bails to guide the position of the casing circulator with respect to the uppermost end of the casing string as the traveling block is lowered;

supporting the casing circulator from the traveling block;

lowering the traveling block with respect to the uppermost end of the casing string such that the casing circulator will be positioned within the uppermost end of the casing string when the elevator is lowered about the uppermost end of the casing string;

thereafter setting the casing circulator to seal the sealing member between the casing string and interior packer tube;

thereafter pumping fluid through a flow line, through the flow path in the packer tube of the set casing circulator and into the casing string to wash the well bore adjacent the lowermost end of the casing string; and thereafter deactivating the casing circular to unseal the sealing element from the casing string.

2. The method as defined in claim 1, wherein the step of providing a casing circulator guide comprises:

providing at least one guide member secured to the casing circulator;

providing at least one guide adjustment member secured to the at least one guide member; and adjusting the at least one guide adjustment member for engagement with one of the bails, such that the position of the casing circulator with respect to the casing string is controlled by adjusting the at least one guide adjustment member.

3. The method as defined in claim 2, further comprising:

providing a support sub for supporting the casing circulator and for transmitting the fluid to the casing circulator; and the at least one guide member is supported by the casing support sub.

4. The method as defined in claim 3, further comprising:

providing a rotary seal between the flow line and a body of the support sub to allow a flow line to rotate with respect to the support sub body.

5. The method defined in claim 1, further comprising:

providing an adjustment mechanism for limiting upward movement of the set casing circulator with respect to the block; and adjusting the adjustment mechanism to prohibit the set casing circulator from moving upward to unseal from the casing string.

6. The method defined in claim 1, wherein the step of setting the casing circulator comprises:

provide a setting flow line from a circulator setting pump to the sealing element of the casing circulator; and activating the casing circulator pump to pass a setting fluid into engagement with the sealing element to set the casing circulator.

7. The method as defined in claim 1, further comprising:

the fluid is a drilling fluid; and the step of pumping fluid includes activating one or more drilling fluid pumps to pump the drilling fluid through the casing circulator.

8. The method as defined in claim 7, further comprising:

passing the drilling fluid through the casing circulator and into the casing string to maintain a desired level of fluid in the casing string is lowered into the well bore.

9. The method as defined in claim 1, further comprising:

providing a seal mechanism within the packer tube for allowing pressurized fluid in the flow line to pass through the casing circulator while preventing unpressurized fluid in the packer tube above the seal mechanism from leaking out the packer tube.

10. An improved method of imputing drilling fluid into a casing string in a well bore so that the casing string may be lowered into the well bore, lowering of the casing string into a well bore controlled by regulating downward movement of a traveling block with respect to a rig floor, an uppermost end of the casing string extending above the rig floor to a position adjacent an elevator suspended by bails from the traveling block for selectively grasping the uppermost end of the casing string, the method comprising:

providing a circulator support sub having a flow path therein;

providing a casing circulator having an exterior sealing member and an interior packer tube defining a fluid flow path;

providing a circulator guide for engagement with the bails to guide the position of the casing circulator with the respect to the uppermost end of the casing string while lowering the traveling block, such that the casing circulator is automatically positioned within the uppermost end of the casing string when the elevator is positioned about the casing string:

suspending the circulator support sub from the traveling block;

suspending the casing circulator from the support sub;

securing the casing string in a fixed position with respect to the rig floor;

lowering the traveling block to a position such that the casing circulator is within the uppermost end of the casing string while the elevator is positioned about the casing string and the casing string is fixed with respect to the rig floor; and thereafter pumping the drilling fluid through the support sub, the casing circulator, and into the casing string.

11. The method as defined in claim 10, wherein the step of providing the circulator guide comprises:

providing at least one guide member secured to the casing support sub;

providing at least one guide adjustment member secured to the at least one guide member; and adjusting the at least one guide adjustment member for engagement with one of the bails, such that the position of the casing circulator with respect to the casing string is controlled by adjusting the at least one guide adjustment member.

12. The method as defined in claim 10, further comprising:

when the casing circulator is within the uppermost end of the casting string, setting the casing circulator to seal the sealing member between the casing circulator and the interior packer tube;

the step of pumping the drilling fluid into the casing string includes washing the well bore adjacent the lowermost end of the casing string; and thereafter deactivating the casing circulator to unseal the sealing member from the casing string.

13. The method as defined in claim 12, further comprising:

providing an adjustment mechanism for limiting upward movement of the set casing circulator with respect to the traveling block; and adjusting the adjacent mechanism to prohibit the set casing circulator from moving upward to unseal from the casing string.

14. The method as defined in claim 10, further comprising:

providing a seal mechanism within the packer tube for allowing pressurized fluid in the flow line to pass through the casing circulator while preventing unpressurized fluid in the packer tube above the seal mechanism from leaking out the packer tube.

15. Circulator apparatus for temporarily sealing the uppermost end of a casing string extending into a well bore, the uppermost end of the casing string extending above the rig floor to a position adjacent an elevator suspended from a traveling block by bails, the circulator apparatus comprising:

a circulator including a packer tube defining a flow path therethrough and an external sealing sleeve radially outward of the packer tube for sealing engagement with an internal surface of the uppermost end of the casing string;

a support sub for suspending from the traveling block and for supporting the circulator, the support sub having a flow path therein for passing fluid to the packer tube flow path; and a guide mechanism supported sub for engagement with the bails to guide the position of the circulator with respect to the uppermost end of the casing string as the traveling block lowers the elevator about the casing string, such that the circulator is automatically lowered onto the interior of the casing string when the traveling block is lowered.

16. A circulator apparatus as defined in claim 15, further comprising:

the guide mechanism includes an adjustment member for selectively adjusting the position of the support sub with respect to the bails as the traveling block is lowered.

17. A circulator apparatus as defined in claim 15, further comprising:

an adjustment mechanism for limiting upward movement of the circulator with respect to the traveling block.

18. A circulator apparatus as defined in claim 15, further comprising:

a flow line for pumping drilling fluid through the support sub and circulator and into the casing string; and a rotary seal mechanism for enabling the flow line to rotate with respect to the support sub while maintaining sealed communication between the flow line and the support sub.

19. A circulator apparatus as defined in claim 15, further comprising:

a seal mechanism within the packer tube for allowing pressurized fluid to pass through the casing circulator while preventing unpressurized fluid in the flow path of the support sub from leaking out the packer tube.

* * * * *

UNITED STATES PATENT AND TRADEMARK OFFICE

CERTIFICATE OF CORRECTION

PATENT NO. : 5,191,939

DATED : March 9, 1993

INVENTOR(S) : Charles O. Stokley

It is certified that error appears in the above-identified patent and that said Letters Patent is hereby corrected as shown below:

In Column 13, line 40, change "a" to --the--.

In Column 13, line 45, before the word "block", insert --traveling--.

In Column 13, line 67, after the word "string", insert --as the casing string-

In Column 14, line 11, before the word "controlled", insert --being--.

In Column 14, line 10, before the word "lowering", insert --the--.

In Colum 16, line 2, change "onto" to --into--.

Signed and Sealed this

Thirtieth Day of November, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,191,939
DATED : March 9, 1993
INVENTOR(S) : Charles O. Stokley

It is certified that error appears in the above-indentified patent and that said Letters Patent is hereby corrected as shown below:

In col. 13, line 17, (Claim 1, line 34) after "casing" delete "circular" and insert --circulator--.

In col. 13, line 36, (Claim 3, line 7) delete "casing" before "support".

In col. 14, line 47, (Claim 11, line 4) delete "casing" before "support".

In col. 14, line 58, (Claim 12, line 4) change "casting" to --casing--.

In col. 14, line 60, (Claim 12, line 6) delete "circulator" and insert --string--.

In col. 15, line 10, (Claim 14, line 4) change "the" to --a-- before "flow line".

In col. 15, line 29, (Claim 15, line 16) after "supported" insert --by the support--.

Signed and Sealed this

Second Day of June, 1998

*Attest:*

Bruce Lehman

BRUCE LEHMAN

*Attesting Officer*

*Commissioner of Patents and Trademarks*